US009214329B2

(12) United States Patent
Calame et al.

(10) Patent No.: US 9,214,329 B2
(45) Date of Patent: Dec. 15, 2015

(54) ELECTRODELESS PLASMA DISCHARGE LAMP

(75) Inventors: Laurent Calame, Genève (CH); Andreas Meyer, Féchy (CH)

(73) Assignee: LUMARTIX SA, Aubonne (CH)

( * ) Notice: Subject to any disclaimer, the term of this patent is extended or adjusted under 35 U.S.C. 154(b) by 0 days.

(21) Appl. No.: 14/119,463

(22) PCT Filed: Jun. 15, 2011

(86) PCT No.: PCT/EP2011/059983

§ 371 (c)(1), (2), (4) Date: Jan. 15, 2014

(87) PCT Pub. No.: WO2012/171564

PCT Pub. Date: Dec. 20, 2012

(65) Prior Publication Data

US 2014/0125225 A1 May 8, 2014

(51) Int. Cl.
*H05B 41/24* (2006.01)
*H01J 65/04* (2006.01)

(52) U.S. Cl.
CPC ..... *H01J 65/042* (2013.01); *H01J 65/044* (2013.01)

(58) Field of Classification Search
CPC ..... H01J 65/042; H01J 65/044; H01J 61/54; H01J 2225/50; H05B 41/44; Y02B 20/22
USPC ..... 315/248, 39, 39.51, 212, 344; 313/231.31, 231.61, 607
See application file for complete search history.

(56) References Cited

U.S. PATENT DOCUMENTS

| | | | | |
|---|---|---|---|---|
| 4,947,080 | A | 8/1990 | Wood | |
| 5,227,698 | A | 7/1993 | Simpson | |
| 5,367,226 | A | 11/1994 | Ukegawa | |
| 5,825,132 | A | 10/1998 | Gabor | |
| 5,998,934 | A | 12/1999 | Mimasu | |
| 6,157,141 | A | 12/2000 | Lapatovich | |
| 6,476,557 | B1 | 11/2002 | Leng | |
| 6,680,576 | B2 * | 1/2004 | Jeon | 315/112 |
| 6,774,581 | B2 * | 8/2004 | Choi et al. | 315/248 |
| 6,873,119 | B2 | 3/2005 | Kim | |
| 6,949,887 | B2 * | 9/2005 | Kirkpatrick et al. | 315/248 |
| 8,188,662 | B2 * | 5/2012 | Hafidi | H01J 65/044 313/607 |
| 9,099,291 | B2 * | 8/2015 | Atol | H01J 65/048 |
| 2004/0178735 | A1 | 9/2004 | Choi | |
| 2008/0203883 | A1 | 8/2008 | Takada | |
| 2010/0134008 | A1 | 6/2010 | Espiau | |

FOREIGN PATENT DOCUMENTS

EP 1876633 A1 1/2008

OTHER PUBLICATIONS

International Search Report for Application No. PCT/EP2011/059983 dated May 7, 2012.

* cited by examiner

*Primary Examiner* — Haissa Philogene
(74) *Attorney, Agent, or Firm* — Pearne & Gordon LLP

(57) ABSTRACT

A discharge lamp (20) for providing visible and/or infrared radiation comprising a stationary light transmitting bulb (21) filled with a composition that emits light when in plasma state, a radiofrequency source (41) having an output terminal (44) radiating a radiofrequency field for ionizing and heating the composition in the bulb to bring it in a plasma state (35), and a dielectric rod (22) aligned with the output terminal and positioned between the output terminal (44) and the bulb (21) acting as dielectric waveguide for the radiofrequency field.

9 Claims, 3 Drawing Sheets

ELECTRODELESS PLASMA DISCHARGE LAMP

FIELD OF THE INVENTION

Embodiments of the present invention relate to discharge lamps, in particular electrodeless discharge lamps in which a luminous plasma is generated by RF or microwave energy.

DESCRIPTION OF RELATED ART

High intensity discharge lamps (HID lamps) are widely employed in lighting thanks to their excellent luminous efficiency and colour rendition. They consist, in many instances, of a transparent envelope containing a gas that is brought in a luminous state by an electric discharge flowing across two electrodes. An electrodeless lamp is a form of discharge lamp in which a transparent bulb, filled with an appropriate composition is heated by Radiofrequency or microwave energy.

Electrodeless lamps tend to exhibit a longer lifetime and maintain better their spectral characteristics along their life than electrode discharge lamps. While requiring a radiofrequency power supply, they use bulbs of very simple structure, without costly glass-metal interfaces. Moreover, the absence of electrodes allows for a much greater variety of light-generating substances to be used than in traditional discharge lamps. Sulphur, Selenium, Tellurium, among others, are a popular fills whose use is limited to electrodeless lamps, because they are not chemically compatible with metal electrodes.

Electrodeless lamps are interesting alternative to conventional HID lamps in general lighting application, and in all fields in which high efficiency and excellent spectral characteristics are called for like photography, movie recording, agriculture, and testing of photovoltaic equipment, among others.

A drawback of conventional electrodeless lamps and of Sulphur lamps in particular, is that the bulb must be kept in rotation to avoid the formation of hot spots that may exceed the maximum operating temperature of the quartz. This increases the cost and size of the lamp and, because the lamp has moving parts, is regarded as a reliability issue.

Several published document describe plasma lamps with special features to suppress the rotation of the bulb. The devices known by U.S. Pat. Nos. 5,227,698, 6,476,557, 6,476,557, 6,873,119, 5,367,226, for example, employ special microwaves polarization schemes in order to spin the plasma discharge, or limit the heat of the plasma in proximity of the envelope walls, instead than spinning the bulb. Such schemes are at least partly effective, but require a more complex microwave system. Other documents, like U.S. Pat. No. 6,157,141 propose to address this shortcoming by adding special chemical additives to the fill, but these pose other problems of cost and toxicity. The patent EP1876633 in the name of the applicant relates to a plasma lamp in which the temperature distribution of the plasma is equalized by a resonant ultrasound wave, which is also effective, but needs additional means to generate and maintain this ultrasound wave in the plasma.

In known plasma lamps the microwave energy source is often a magnetron emitting in the open 2.45 GHz band, because such generators are readily available at attractive market prices. The bulb is generally placed in a resonant cavity, connected with the magnetron by a waveguide or another transmission line. The purpose of the cavity is to improve the energy transfer to the plasma without transmitting too much power to the bulb's walls and limit the emission of radiofrequency to the outside. The waveguide separates the very hot bulb from the magnetron and avoid that this may overheat. This introduces however additional costs, and the boundaries of the cavity may interfere with light transmission.

It is an object of the present invention to propose an electrodeless plasma lamp with a stationary bulb in which the temperature of the bulb is managed in a simpler manner than in the know devices.

BRIEF SUMMARY OF THE INVENTION

According to the invention, these aims are achieved by means of the object of the appended claims.

BRIEF DESCRIPTION OF THE DRAWINGS

The invention will be better understood with the aid of the description of an embodiment given by way of example and illustrated by the figures, in which.

DETAILED DESCRIPTION OF POSSIBLE EMBODIMENTS OF THE INVENTION

Figure 1:
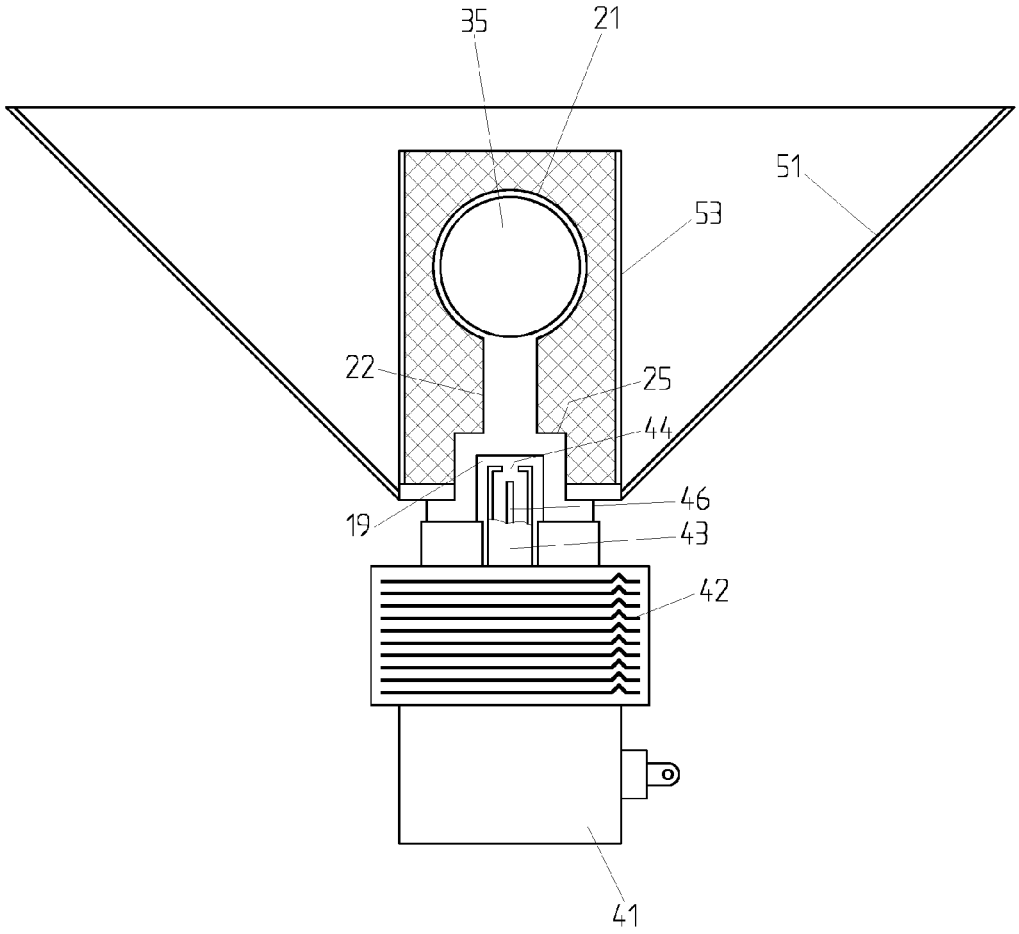
FIG. 1 shows schematically a discharge lamp according to one aspect of the invention.

With reference to the FIG. 1, a discharge lamp 20 comprises a sealed transparent bulb 21 filled with a chemical composition that is suitable for producing light when it is ionized and heated to a plasma state 35. Several compositions can be used as fill in the frame of the present invention including, for example, Sulphur, Selenium, Tellurium, metal halides and mixtures thereof, in an inert atmosphere. The present invention, however, is not limited to a particular chemical composition.

The bulb is realized in a transparent material capable to withstand the high temperatures and internal pressures that are reached during the functioning of the lamp, and chemically compatible with the fill composition. In a typical realization of the invention the operating temperature of the bulb 21 will be comprised between 600° C. and 900° C., and the internal pressure at operation is comprised between 0.1 MPa and 2 MPa. Fused quartz (also fused silica, $SiO_2$) is a preferred material for the bulb.

According to the desired power, the size of the bulb 21 may vary between 0.5 $cm^3$ and 100 $cm^3$ typically around 10-30 $cm^3$. The shape of the bulb can vary, but the spherical shape is preferred because it offers the best resistance to internal pressure.

The bulb 21 is placed in a light concentrator 51 and in an electromagnetic enclosure of metallic mesh 53. The concentrator 51 has preferably reflective walls, in order to concentrate the light generated in the bulb 22 into a beam of the desired aperture, and is electrically conductive, in order to avoid transmission of the microwaves out of the lamp assembly. The metallic mesh enclosure 53 has the function of confining the radiofrequency field inside lamp and is connected mechanically and electrically to the lamp by any suitable means, for example by the collar 52 visible in FIG. 3. It has been found that the dimensions of the reflector 51 and of the electromagnetic enclosure 53 and the placement of the bulb in them are not critical: the lamp works satisfactorily without a need of tuning the dimension of these elements to the wavelength of the incident microwaves. In some cases where a strict electromagnetic management it is not necessary, for example when the lamp fully enclosed in a larger system, the metallic mesh 53 and/or the concentrator 51 could be suppressed. The enclosure 53 could also, in a variant, be realized with sheets of a suitable transparent, translucent, or light-transmitting substrate on which a thin electrically conductive layer is deposed.

The radiofrequency source is for instance a magnetron tube 41 generating a radiofrequency signal of appropriate intensity, and having a terminal 43 that is provided by the manufacturer to couple the magnetron to a standardised waveguide. Such terminals consist typically in a coaxial transmission line having a central conductor 46 that is closed by a cap with an aperture 44, or in a hollow ¼ wavelength waveguide. The cooling fins 42 are cooled preferably by a flow of forced air from a fan (not shown).

In the lamp of the present invention the bulb 21 is mounted atop a dielectric rod 22 that is in turn welded axially to a quartz socket 25 whose inner dimension correspond to the outer dimension of the microwave terminal 43, so that the latter can fit into the socket 25. Preferably, bulb 21, rod 22, and socket 25 are integrally fabricated in a single piece of fused quartz, but the invention contemplates also variant in which these elements are realized separately, and then assembled together, and are made of any suitable material.

It has been verified that the dimensions of the dielectric rod 22 affect the transfer of energy to the bulb 21. Bulbs in which the rod 22 has a diameter up to 20 mm and a length up to 50 mm have provided satisfactory luminous efficiency and reliability. Preferably, the length of the rod 22 will be between 5 and 50 mm, more preferably between 10 and 25 mm. As to the diameter, it is preferably comprised between 2 mm and 20 mm, more preferably between 4 mm and 15 mm. The invention is not however limited to such dimensions.

The lamp of the invention provides strong light flux, starts up easily, and operates reliably without the need of spinning the bulb to cool it. Without willing to be limited by theory, it is believed that the dielectric rod 22 acts as a dielectric waveguide and channels the microwave energy directly into the inner volume of the bulb 21, thus obviating the absence of a resonant cavity. Electromagnetic losses in the dielectric are rather low, and so is the thermal transmission coefficient of quartz, thus the thermal load on the magnetron is well manageable. It has been found that it is preferable to have a socket slightly longer than the terminal so that an air gap 19 remains between the inner wall of the socket 25 and the terminal 43.

Figure 2:
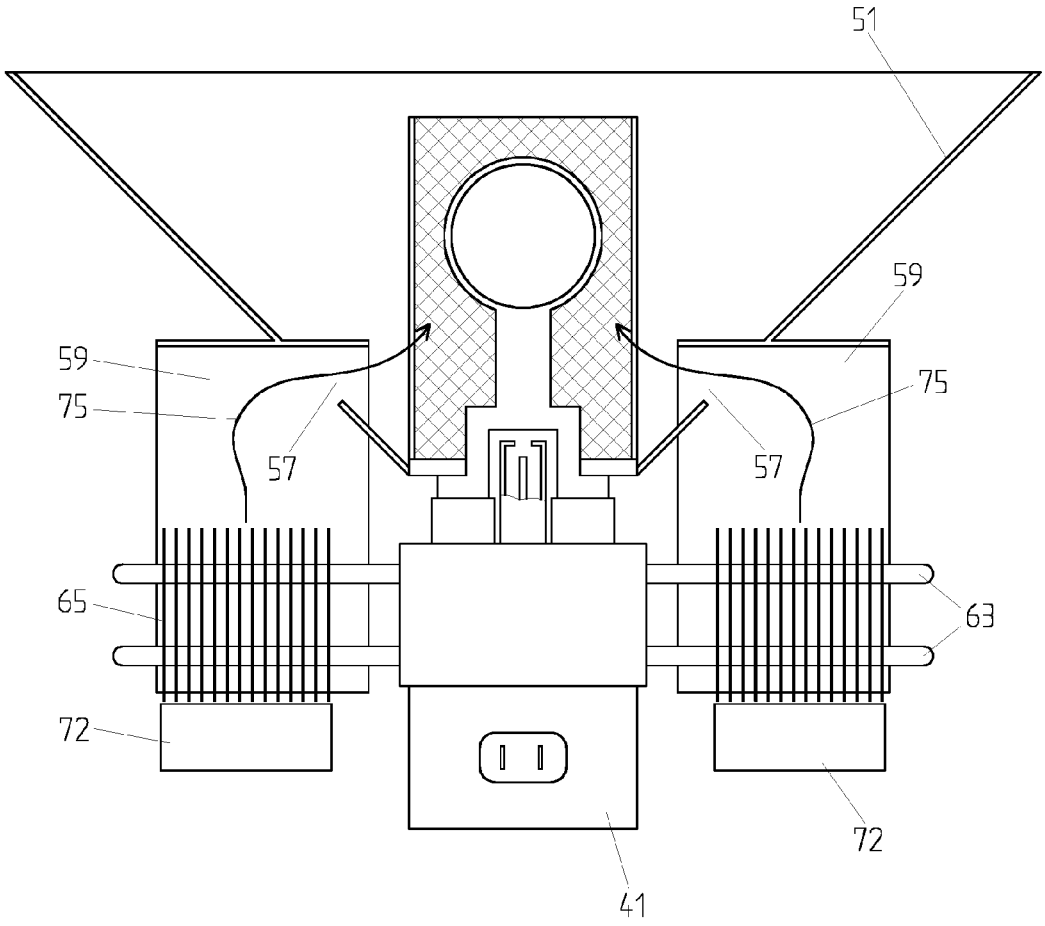
FIG. 2 illustrates a variant of the inventive lamp.

FIG. 2 illustrates a variant of the invention having an improved cooling system. The magnetron 41 is thermally connected to a plurality of heat pipes 63 that are in turn cooled by the stack of fins 65. The fans 72 force cool air through the fins 65 and, by the air deflectors 59 and the openings 57 in the concentrator 51, on the bulb 21.

Figure 3:
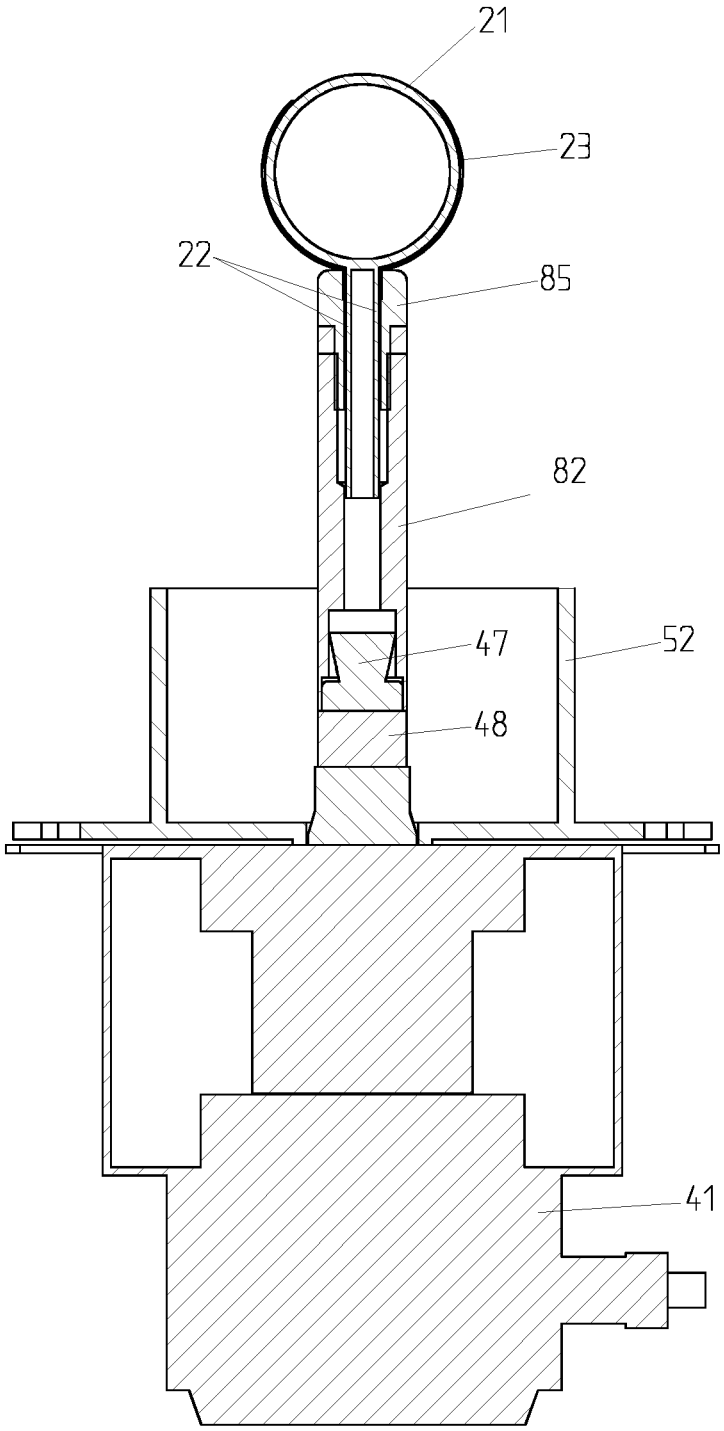
FIG. 3 shows a further variant of the lamp of the invention

FIG. 3 shows another variant of the invention in which the magnetron 41 has an output RF terminal 47 supported by a ceramic isolator 48 and coupled to a ¾ wavelength waveguide 82. The bulb 21 is equipped by a dielectric quartz rod 22, integrally fabricated with the bulb 21 that is inserted in the waveguide 82 and held in place by the collet 85, or by any suitable fixation means. This variant provide an alternative manner of connecting the bulb 22 to the magnetron with a compact waveguide that does not increase the dimensions of the lamp, and is easy to machine. It has been found that this variant of the lamp works with solid quartz rods as well as with hollow rods 22.

The bulb 21 of FIG. 3 also includes a diffuser film 23 that covers partially the outer surface of the bulb and has the function of equalizing the light output and promotes light emission in the forward direction. The diffuser film can be realized with a suitable diffuser material that is capable of withstanding the bulb's operating temperature, for example a composition of an oxide of Zr, Si, or Ti and an inorganic high-temperature binder. In alternative, the diffuser film 23 could be deposited in the inner surface of the bulb, provided it is chemically compatible with the fill, or be realized by etching, frosting or structuring the surface of the quartz bulb itself.

REFERENCE NUMBERS USED IN THE FIGURES

19 air gap
21 bulb
22 dielectric rod
23 light diffuser film
25 socket
35 plasma region
41 magnetron
42 cooling fins
43 terminal/RF launcher (partially in section)
44 aperture
46 coaxial line
47 RF terminal
48 insulator
51 light concentrator
52 supporting collar
53 electromagnetic enclosure
57 openings
59 air deflectors
63 heat pipes
65 fins
72 fan
75 air flow
82 ¾ wavelength guide
85 collet

The invention claimed is:

1. A discharge lamp for providing visible and/or infrared and/or UV radiation comprising a stationary light transmitting bulb filled with a composition that emits light when in plasma state, a radiofrequency source having an output terminal radiating a radiofrequency field for ionizing and heating the composition in the bulb to bring it in a plasma state, and a dielectric rod aligned with the output terminal and positioned between the output terminal and the bulb.

2. The discharge lamp of claim 1, in which the dielectric rod acts as dielectric waveguide for the radiofrequency field.

3. The discharge lamp claim 2, in which the dielectric rod is a solid homogeneous element of the same material as the bulb and in which the bulb and the rod welded or integrally fabricated are in a single piece.

4. The discharge lamp of claim 3, in which the dielectric rod is welded to or integrally fabricated with a socket 25 of the same material in which is inserted the output terminal of the radiofrequency source.

5. The discharge lamp of claim 1, in which the output terminal is coupled to a waveguide, in which the rod is inserted.

6. The discharge lamp claim 1, in which the bulb and rod are of fused silica or fused quartz.

7. The discharge lamp claim 1, in which the radiofrequency source is a magnetron tube and the output terminal is a waveguide having an aperture at its extremity.

8. The discharge lamp of claim 1, further including a reflector or light concentrator and a mesh or an electrically conductive layer deposited on a transparent or light-transmitting substrate acting as an electromagnetic shield to confine the radiofrequency field.

9. The discharge lamp of claim 1, wherein a longitudinal axis of the dielectric rod is aligned with both the output terminal and the bulb, and both ends of the dielectric rod are positioned between the output terminal and the bulb.

* * * * *